US009089959B2

(12) United States Patent
Hsu et al.

(10) Patent No.: US 9,089,959 B2
(45) Date of Patent: Jul. 28, 2015

(54) CORDLESS CLINCHING TOOL

(71) Applicant: TECHWAY INDUSTRIAL CO., LTD., Taichung (TW)

(72) Inventors: Chih-Hua Hsu, Taichung (TW); Chun-Jen Su, Taichung (TW); Shao-Lung Chiu, Taichung (TW)

(73) Assignee: TECHWAY INDUSTRIAL CO., LTD., Taichung (TW)

( * ) Notice: Subject to any disclaimer, the term of this patent is extended or adjusted under 35 U.S.C. 154(b) by 210 days.

(21) Appl. No.: 13/945,296

(22) Filed: Jul. 18, 2013

(65) Prior Publication Data

US 2015/0020567 A1 Jan. 22, 2015

(51) Int. Cl.
*B25B 27/14* (2006.01)
*B25B 23/06* (2006.01)

(52) U.S. Cl.
CPC ..... *B25B 27/146* (2013.01); *B25B 23/06* (2013.01)

(58) Field of Classification Search
CPC ..... B25B 23/06; B25B 27/146
USPC ..... 29/513, 816, 243.56, 525.05, 809, 29/811.2; 72/452.8, 452.9, 409.02, 72/409.03, 409.05, 409.1, 453.15, 407, 72/453.16
See application file for complete search history.

(56) References Cited

U.S. PATENT DOCUMENTS 2,656,539 A * 10/1953 Chilton ..... 72/407
3,830,089 A 8/1974 Boyd et al.

FOREIGN PATENT DOCUMENTS

| | | |
|---|---|---|
| EP | 0274710 | 7/1988 |
| EP | 0976504 | 2/2000 |
| TW | 201127565 | 2/2010 |
| TW | 201127565 A1 * | 8/2011 |

OTHER PUBLICATIONS

INPI search report for French application 1357963, issued on May 22, 2014.

* cited by examiner

*Primary Examiner* — Shelley Self
*Assistant Examiner* — Peter Iannuzzi
(74) *Attorney, Agent, or Firm* — Ming Chow; Sinorica, LLC

(57) ABSTRACT

A cordless clinching tool has a case body, a nail clamping unit, a nail transportation unit, a pushing device, a driving device, and a cell assembly. The case body has a cell engaging portion. The nail clamping unit is mounted in the case body. The nail transportation unit is mounted on a side of the case body and has a nail track. The pushing device is mounted in the case body and pushes the nail clamping unit. The driving device is mounted in the case body and drives the pushing device. The cell assembly is mounted on the cell engaging portion and provides a power for the driving device.

7 Claims, 11 Drawing Sheets

CORDLESS CLINCHING TOOL

BACKGROUND OF THE INVENTION

1. Field of the Invention

The present invention relates to a clinching tool, and more particularly to a cordless clinching tool.

2. Description of Related Art

A conventional clinching tool comprises a piston structure, a nail clamping unit, a pushing stick, and a nail transportation unit. The piston structure is mounted in the clinching tool and is powered by a pneumatic device, such that the piston structure can be moved back and forth in the clinching tool. The nail clamping unit is mounted on a front of the piston structure and can be pushed by the piston structure. The pushing stick is mounted in the clinching tool. The nail transportation unit is mounted on a side of the clinching tool. The nail transportation unit can transport multiple C-shaped nails into a clamping mouth of the nail clamping unit sequentially.

In use, the pneumatic device provides a power for the piston structure. The piston structure pushes the pushing stick forth, and then the pushing stick pushes a C-shaped nail to the clamping mouth. The piston structure moves backward. A supporting wheel supports the clamping mouth to enable a front end of the clamping mouth to clamp the C-shaped nail such that the C-shaped nail is formed into a ringed structure to tie a mesh or a branch in gardening use.

However, the conventional clinching tool is powered by the pneumatic device, so the clinching tool is used by coordinating with an air compressor. The air compressor is heavy in weight and can hardly be transported. Therefore, the clinching tool cannot be used in an outdoor environment or in high altitude. In addition, the clinching tool is connected with the air compressor by pipelines. The pipelines may cause an inconvenience for working. As a result, the use of the clinching tool is restricted in the working environment and the operation.

SUMMARY OF THE INVENTION

The main objective of the present invention is to provide a cordless clinching tool to resolve the problems of the conventional clinching tool.

The cordless clinching tool comprises a case body, a nail clamping unit, a nail transportation unit, a pushing device, a driving device, and a cell assembly.

The case body comprises a grip and a gun body. The grip comprises a bottom, a top, a button opening, a switch, a button, a cell, a first connecting terminal, and a main circuit board.

The button opening is formed through a front side of the top of the grip. The switch is mounted in the top of the grip and comprises a front side. The button is combined with the front side of the switch and protrudes out of the grip from the button opening. The cell engaging portion is mounted on the bottom of the grip and comprises a bottom surface. The first connecting terminal is mounted on the bottom surface of the cell engaging portion. The main circuit board is mounted in the bottom of the grip and is electrically connected with the first connecting terminal and the switch.

The gun body is combined with the top of the grip and comprises a front, a rear, a side, and a nail clamping unit chamber formed in the gun body. The clamping unit chamber comprises a chamber opening formed through the front of the gun body.

The gun body further comprises a pushing chamber, a driving device chamber, and a connecting chamber. The pushing chamber is formed in the gun body and communicates with the nail clamping unit chamber and comprises a middle and a rear end. The driving device chamber is formed in the gun body, is above the nail clamping unit chamber and comprises a rear end. The connecting chamber is formed in the gun body, is above the pushing chamber. The connecting chamber further comprises a middle, a front end communicating with the rear end of the driving device chamber, and a bottom communicating with a top of the middle of the pushing chamber.

The nail clamping unit is mounted in the nail clamping unit chamber of the case body and comprises a side, a front half part protruding out of the nail clamping unit chamber from the chamber opening of the nail clamping unit chamber, a nail entrance formed through the side of the nail clamping unit, a pushing stick being elongated, mounted in the nail clamping unit. The pushing stick further comprises a rear end. The nail clamping unit further comprises an abutting head mounted on the rear end of the pushing stick and located in the pushing chamber.

The nail transportation unit is mounted on the side of the gun body and comprises a nail track mounted on the side of the gun body and connected with the nail entrance.

The pushing device is mounted in the pushing chamber and comprises a track being elongated and mounted in the pushing chamber, a sliding base mounted in the track slidably, combined with the abutting head and comprising a top. The pushing device further comprises a spring mounted between the rear end of the pushing chamber and the abutting head. The pushing device further comprises an engaging base mounted on the top of the sliding base. The engaging base comprises a front end, a rear end, a lower engaging portion mounted on the front end of the engaging base and having a height, and an upper engaging portion mounted on the rear end of the engaging base and having a height, wherein the height of the upper engaging portion is longer than the height of the lower engaging portion.

The driving device is mounted in the driving device chamber and the connecting chamber and comprises a motor mounted in the driving device chamber, electrically connected with the main circuit board and comprising a rear end. The driving device further comprises a decelerating gear assembly connected with the rear end of the motor and comprising a rear end. The driving device further comprises a driving bevel gear connected with the rear end of the decelerating gear assembly and protruding into the connecting chamber. The driving device further comprises a gear axle mounted in the middle of the connecting chamber rotatably and comprising a top. The driving device further comprises a driven bevel gear mounted around the top of the gear axle, engaging with the driving bevel gear and comprising a bottom. The driving device further comprises a rotating plate combined with the bottom of the driven bevel gear rotatably and comprising a bottom. The driving device further comprises a long pushing unit mounted on the bottom of the rotating plate, selectively pushing the lower engaging portion and having a height. The driving device further comprises a short pushing unit mounted on the bottom of the rotating plate, selectively pushing the upper engaging portion and having a height. The height of the long pushing unit is longer than the height of the short pushing unit. The long pushing unit and the short pushing unit are eccentric relative to the gear axle.

The cell assembly is removably mounted on the cell engaging portion of the grip and comprises a top, a second connecting terminal mounted on the top of the cell assembly and electrically connected with the first connecting terminal.

Other objectives, advantages and novel features of the present invention will become more apparent from the following detailed description when taken in conjunction with the accompanying drawings.

DETAILED DESCRIPTION OF PREFERRED EMBODIMENT

Figure 1:
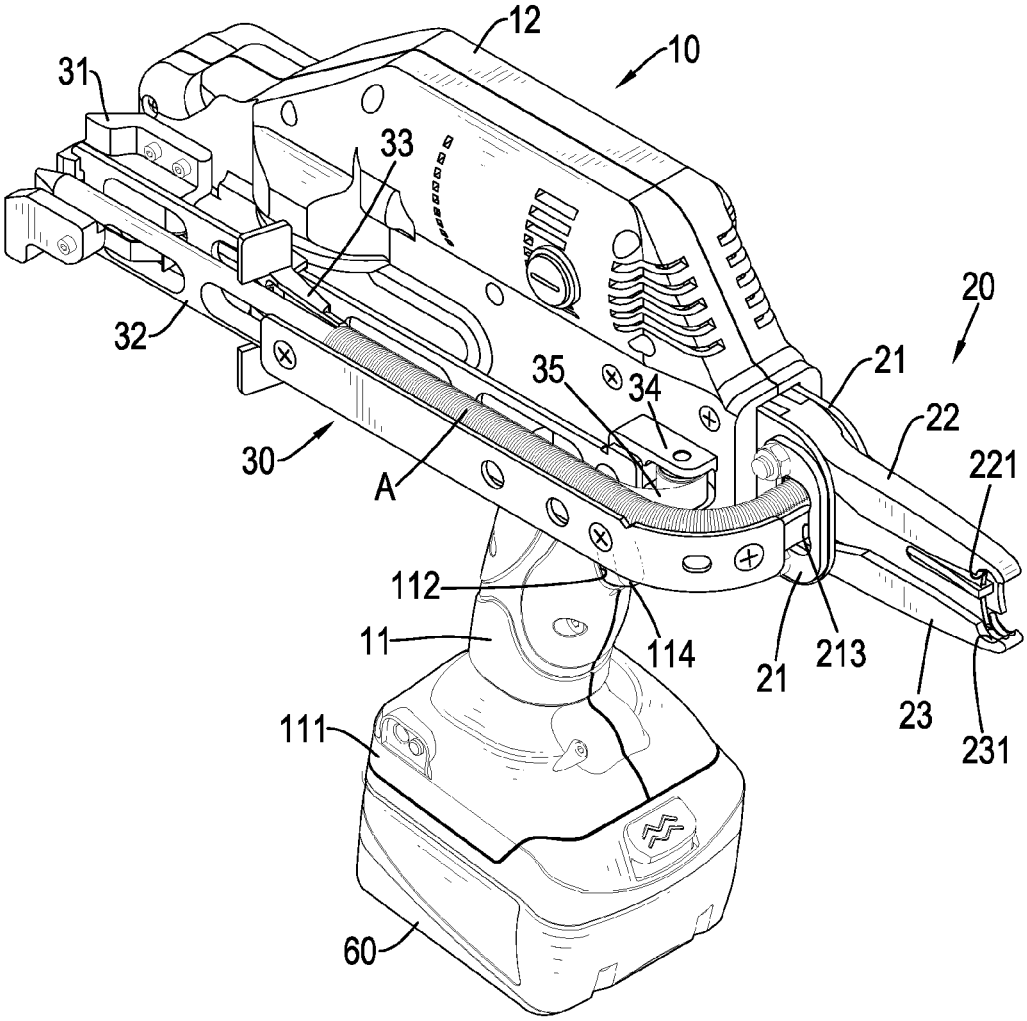
FIG. 1 is a perspective view of a preferred embodiment of a cordless clinching tool in accordance with the present invention.

With reference to FIGS. 1 to 4, a preferred embodiment of a cordless clinching tool in accordance with the present invention comprises a case body 10, a nail clamping unit 20, a nail transportation unit 30, a pushing device 40, a driving device 50, and a cell assembly 60.

The case body 10 comprises a grip 11 and a gun body 12. The grip 11 is elongated and comprises a cell engaging portion 111, a button opening 112, a switch 113, a button 114, a first connecting terminal 115, and a main circuit board 116. The cell engaging portion 111 is mounted on a bottom of the grip 11. The button opening 112 is formed through a front side of a top of the grip 11. The switch 113 is mounted in the top of the grip 11. The button 114 is combined with a front side of the switch 113 and protrudes out of the grip 11 from the button opening 112. The first connecting terminal 115 is mounted on a bottom surface of the cell engaging portion 111. The main circuit board 116 is mounted in the bottom of the grip 11 and is electrically connected with the switch 113 and the first connecting terminal 115.

The gun body 12 is elongated and is combined with the top of the grip 11. The gun body 12 comprises a front, a rear, a top, a bottom, a middle, a front half part, a rear half part, an upper half part, a lower half part, a right side, a left side, a nail clamping unit chamber 121, a pushing chamber 122, a driving device chamber 123, and a connecting chamber 124. The front half part of the gun body 12 is defined between the front and the middle of the gun body 12. The rear half part of the gun body 12 is defined between the rear and the middle of the gun body 12. The upper half part of the gun body 12 is defined between the top and the middle of the gun body 12. The lower half part of the gun body 12 is defined between the bottom and the middle of the gun body 12. The nail clamping unit chamber 121 is formed in the front half part and the lower half part of the gun body 12 and comprises a chamber opening 1211 formed through the front of the gun body 12. The pushing chamber 122 is elongated and is formed in the rear half part and the lower half part of the gun body 12. A front end of the pushing chamber 122 communicates with a rear end of the nail clamping unit chamber 121. The pushing chamber 122 comprises a spring hole 1221 formed inside the gun body 12 and located at a rear end of the pushing chamber 122.

The driving device chamber 123 is formed in the front half part and the upper half part of the gun body 12 and is above the nail clamping unit chamber 121. The connecting chamber 124 is formed in the rear half part and the upper half part of the gun body 12 and is above the pushing chamber 122. A front end of the connecting chamber 124 communicates with a rear end of the driving device chamber 123, and a bottom of the connecting chamber 124 communicates with a top of a middle of the pushing chamber 122.

The nail clamping unit 20 is mounted in the case body 10 and comprises two side boards 21, an upper clamping mouth axle 211, a lower clamping mouth axle 212, a fixing block 214, an upper clamping mouth 22, a lower clamping mouth 23, a pushing plate 24, a pushing stick 25, and an abutting head 26. The side boards 21 are elongated, extend along the gun body 12, and are mounted on the front half part and the lower half part of the gun body 12. Two front ends of the side boards 21 protrude out of the chamber opening 1211. The upper clamping mouth axle 211 is mounted through the front sides of the side boards 21 and is located at the tops of the side boards 21. The lower clamping mouth axle 212 is mounted on the front sides of the side boards 21 and is located at the bottoms of the side boards 21. One of the side boards 21 comprises a nail entrance 213 formed through the side board 21 and being adjacent to the front side of the side board 21. The fixing block 214 is mounted between the side boards 21 and is located at the rear sides of the side boards 21. The fixing block 214 comprises a block hole 2141 formed through a middle of the fixing block 214 from a front side to a rear side of the fixing block 214.

The upper clamping mouth 22 is elongated, extends along the gun body 12, and is mounted around the upper clamping mouth axle 211. The upper clamping mouth 22 comprises a middle, a front end, a rear end, a front half part, a rear half part, and an upper clamping portion 221. The middle of the upper clamping mouth 22 is mounted around the upper clamping mouth axle 211 swingingly, such that the upper clamping mouth 22 can be swung relative to the upper clamping mouth axle 211. The front half part is defined between the middle and the front end of the upper clamping mouth 22. The rear half part is defined between the middle and the rear end of the upper clamping mouth 22. The upper clamping portion 221 is mounted on the front end of the upper clamping mouth 22. The lower clamping mouth 23 comprises a middle, a front end, a rear end, a front half part, a rear half part, and a lower clamping portion 231. The middle of the lower clamping mouth 23 is mounted around the lower clamping mouth axle 212 swingingly, such that the lower clamping mouth 23 can be swung relative to the lower clamping mouth axle 212. The front half part is defined between the middle and the front end of the lower clamping mouth 23. The rear half part is defined between the middle and the rear end of the lower clamping mouth 23. The lower clamping portion 231 is mounted on the front end of the lower clamping mouth 23.

Figure 6:
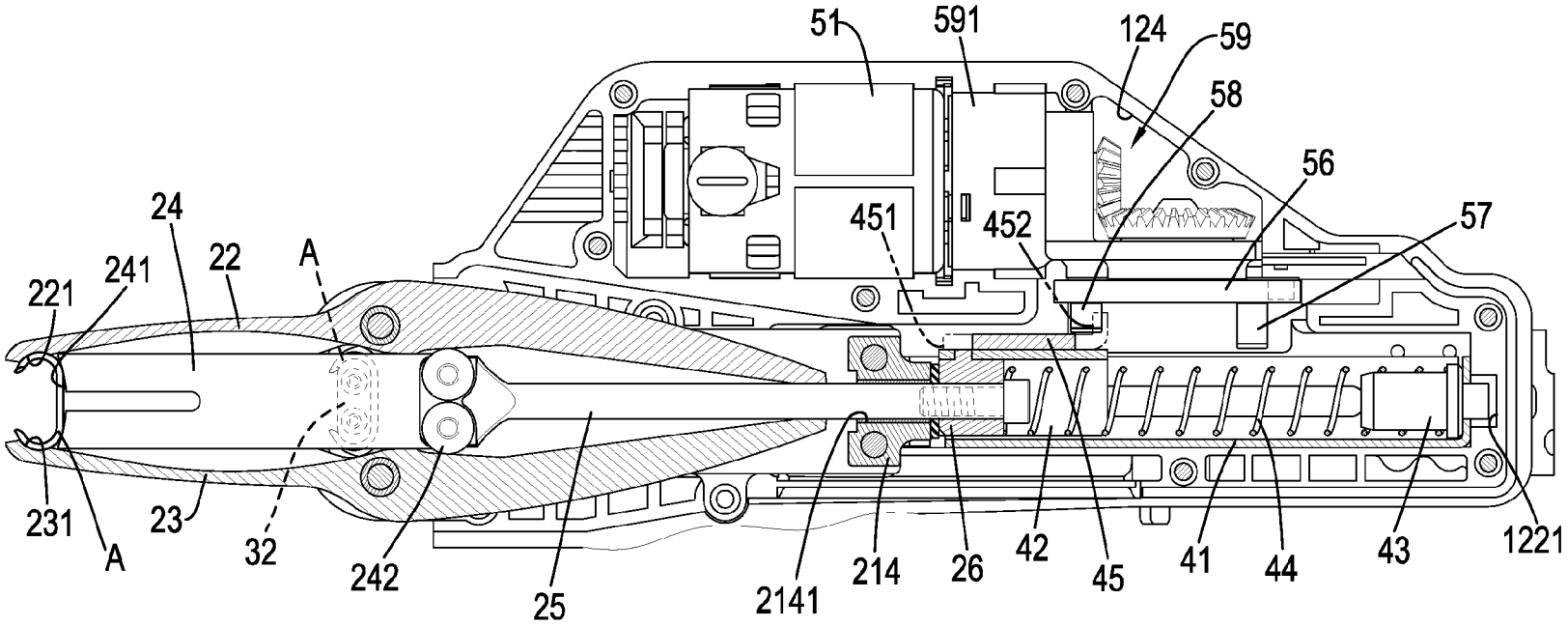
FIG. 6 is an enlarged side view in partial section of the cordless clinching tool in FIG. 1.

With further reference to FIG. 6, the pushing plate 24 is elongated, extends along the gun body 12, and is mounted between the front half part of the upper clamping mouth 22 and the front half part of the lower clamping mouth 23. The pushing plate 24 comprises a front end, a pushing surface 241 and two supporting wheels 242. A top and a bottom of the front end of the pushing plate 24 abut the bottom of the front end of the upper clamping mouth 22 and the top of the front end of the lower clamping mouth 23 respectively, such that the upper clamping portion 221 and the lower clamping portion 231 are supported to be detached from each other for accommodating a C-shaped nail. The pushing surface 241 is curved and is concaved from the front end of the pushing plate 24 to push the C-shaped nail. The supporting wheels 242 are rotatably mounted on a top and a bottom of a rear end of the pushing plate 24 and abut the rear half part of the upper clamping mouth 22 and the rear half part of the lower clamping mouth 23 respectively. When the supporting wheels 242 are moving towards the rear end of the upper clamping mouth 22 and the rear end of the lower clamping mouth 23, the rear end of the upper clamping mouth 22 and the rear end of the lower clamping mouth 23 are detached from each other and the upper clamping portion 221 and the lower clamping portion 231 approach each other to clamp the C-shaped nail.

The pushing stick 25 is elongated, extends along the gun body 12, and is mounted on a middle of the rear end of the pushing plate 24. A rear end of the pushing stick 25 opposite to the pushing plate 24 is inserted through the block hole 2141 and protrudes into the pushing chamber 122. The abutting head 26 is mounted on the rear end of the pushing stick 25.

Figure 2:
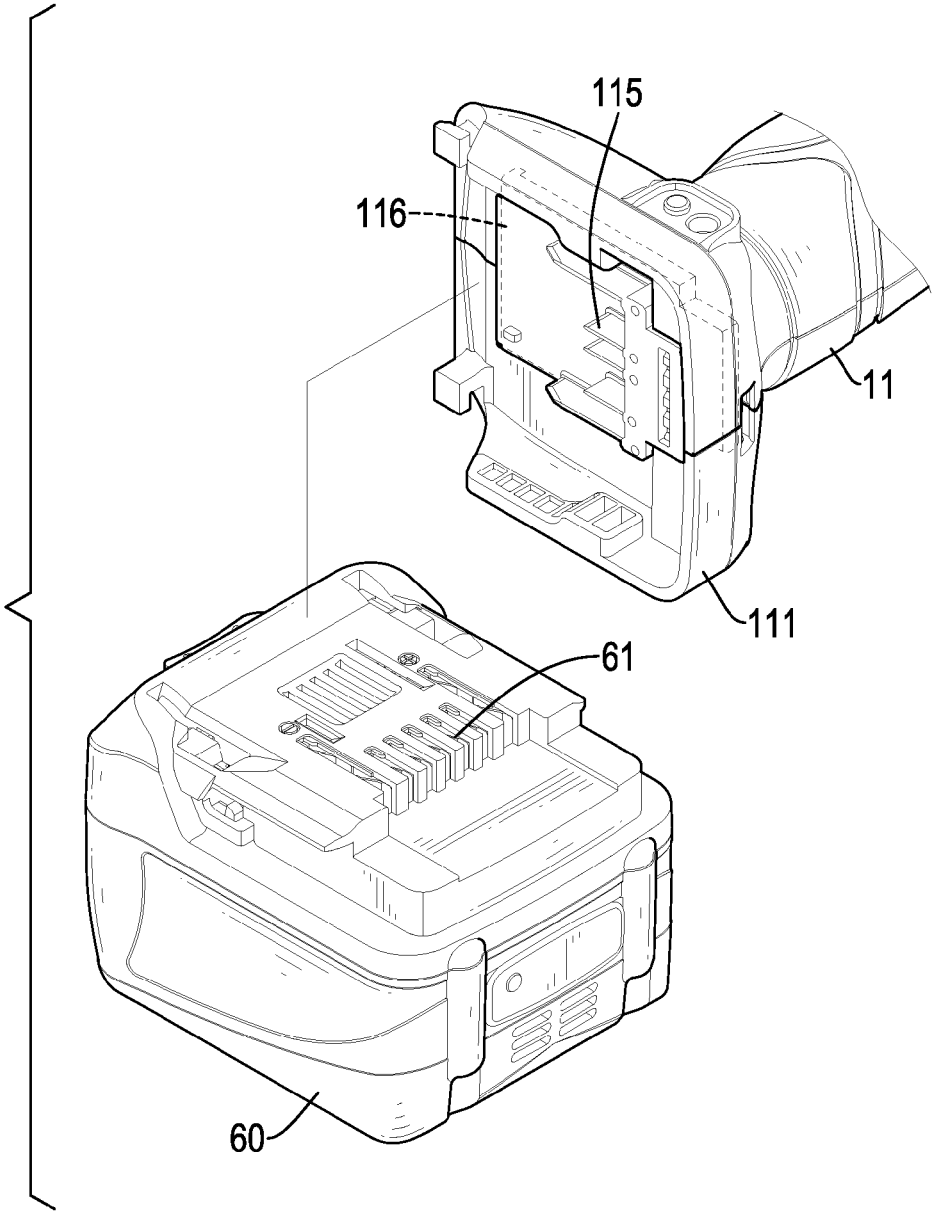
FIG. 2 is a partially enlarged exploded perspective view of the cordless clinching tool in FIG. 1.

With reference to FIGS. 1 and 2, the nail transportation unit 30 is mounted on the right side of the gun body 12 and comprises a nail track base 31, a nail track 32, a nail pushing block 33, a retractor spring base 34, and a retractor spring 35. The nail track base 31 is mounted on the right side of the gun body and is adjacent to the rear of the gun body 12. The nail track 32 is mounted on the nail track base 31 and extends toward the front of the gun body 12. A front end of the nail track 32 is bent leftward and is connected with the nail entrance 213 of the side board 21 of the nail clamping unit 20. Multiple C-shaped nails A are mounted in the nail track 32. The nail pushing block 33 is slidably mounted in the nail track 32, such that the nail pushing block 33 can slide back and forth relative to the nail track 32. The nail pushing block 33 abuts the C-shaped nails A. The retractor spring base 34 is mounted on the right side of the gun body and is adjacent to the front of the gun body 12. The retractor spring 35 is mounted in the retractor spring base 34, and a part of the retractor spring 35 is pulled from the retractor spring base 34 and an end of the retractor spring 35 is connected with the nail pushing block 33. The retractor spring 35 has an elastic force enabling the end of the retractor spring 35 connected with the nail pushing block 33 to be retractable toward the retractor spring base 34, such that the nail pushing block 33 is pulled by the retractor spring 35 to push the C-shaped nails A in the nail track 32.

Figure 3:
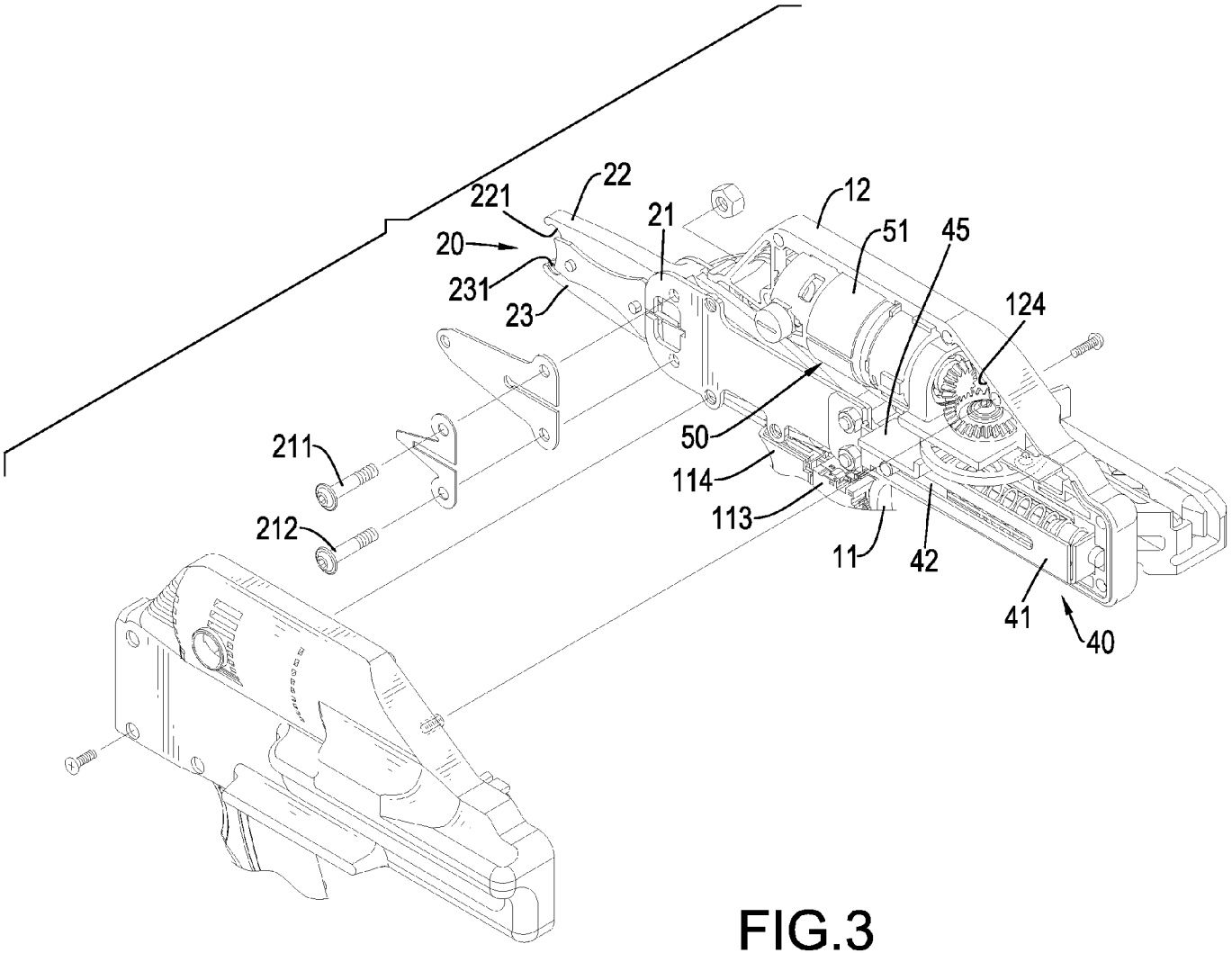
FIG. 3 is a partially exploded perspective view of the cordless clinching tool in FIG. 1.
Figure 4:
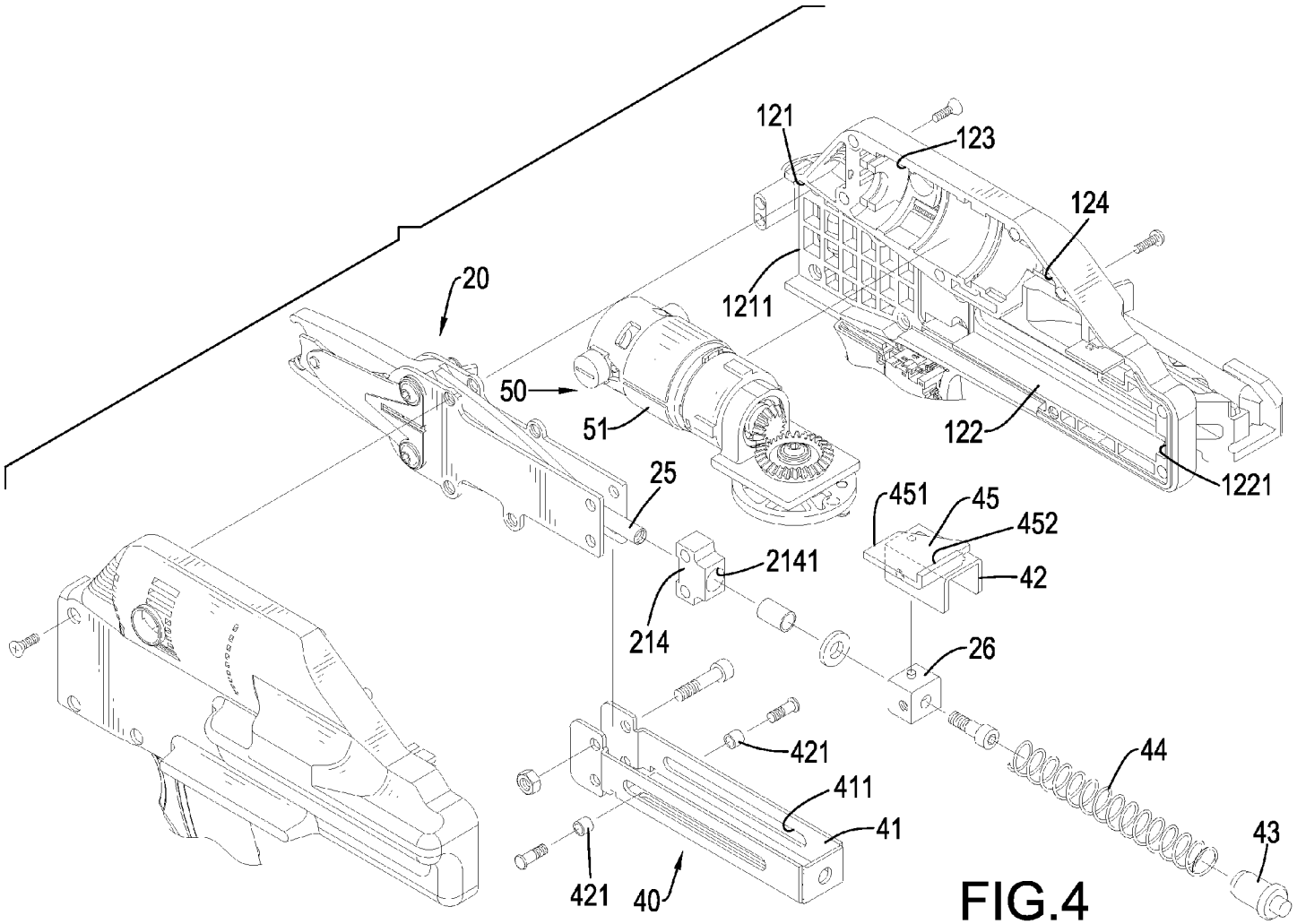
FIG. 4 is a partially exploded perspective view of the cordless clinching tool in FIG. 1.

With reference to FIGS. 3, 4 and 6, the pushing device 40 is mounted in the pushing chamber 122 and comprises a track 41, a sliding base 42, a spring base 43, a spring 44, and an engaging base 45. The track 41 is elongated and is mounted in the pushing chamber 122. The track 41 comprises a cross section, a left side, a right side, a front end, and two guiding holes 411. The cross section of the track 41 is U-shaped. The guiding holes 411 are elongated, are formed through the right side and the left side of the track 41 respectively and align each other. The sliding base 42 is mounted in the front end of the track 41 slidably, is mounted around the abutting head 26 and comprises a right side, a left side, and two guiding pins 421. The guiding pins 421 are each respectively mounted through the guiding holes 411, are mounted through the right side and the left side of the sliding base 42 respectively, and are combined with a right side and a left side of the abutting head 26 by threads respectively. The guiding pins 421 can move back and forth in the guiding holes 411. The spring base 43 is mounted in the track 41 and is inserted into the spring hole 1221. The spring 44 is mounted between the spring base 43 and the abutting head 26. The engaging base 45 is L-shaped, is mounted on a left half portion of a top of the sliding base 42 and comprises a lower engaging portion 451 and an upper engaging portion 452. The lower engaging portion 451 is located at a front end of the engaging base 45 and has a height. The upper engaging portion 452 is located at a rear end of the engaging base 45 and has a height, wherein the height of the upper engaging portion 452 is higher than the height of the lower engaging portion 451 relative to the sliding base 42.

With reference to FIGS. 5 to 8, the driving device 50 is mounted in the driving device chamber 123 and the connecting chamber 124 and comprises a gear base 59, a front bearing 5911, a lower bearing 5921, a motor 51, a decelerating gear assembly 52, a driving bevel gear 53, a gear axle 54, a driven bevel gear 55, a rotating plate 56, a long pushing unit 57, a short pushing unit 58, a magnetic unit 571, an electric board 572, and a magnetic field sensor 573. The gear base 59 is L-shaped, is mounted in the driving device chamber 123 and comprises a motor sleeve 591 and a bearing base 592. The motor sleeve 591 is mounted at a front side of the gear base 59. The bearing base 592 is mounted at a middle of a bottom of the gear base 59. The front bearing 5911 is mounted in a rear end of the gear base 59. The lower bearing 5921 is mounted in the bearing base 592. The motor 51 is mounted in the motor sleeve 591 and is electrically connected with the main circuit board 116. The decelerating gear assembly 52 is connected with a rear end of the motor 51 and a rear end of the decelerating gear assembly 52 is inserted into the front bearing 5911. The driving bevel gear 53 is connected with the rear end of the decelerating gear assembly 52. The gear axle 54 is elongated and is mounted in the lower bearing 5921. The driven bevel gear 55 is mounted around a top of the gear axle 54 and engages the driving bevel gear 53. The rotating plate 56 is circular, is rotatably and concentrically combined with a bottom of the driven bevel gear 55 and is above the track 41, wherein a diameter of the rotating plate 56 is larger than a diameter of the driven bevel gear 55. The long pushing unit 57 is rotatable, is mounted on a bottom of the rotating plate 56 and extends toward the track 41. An initial position of the long pushing unit 57 is located at a right side of the rear end of the rotating plate 56 and at a right side of a rear of the lower engaging portion 451. The short pushing unit 58 is rotatable, is shorter than the long pushing unit 57, is mounted on the bottom of the rotating plate 56 and extends toward the track 41. An initial position of the short pushing unit 58 is located at a right side of a front end of the rotating plate 56 and at a right side of the upper engaging portion 452. When the rotating plate 56 is rotated, the short pushing unit 58 is moved to a front of the upper engaging portion 452 and pushes the engaging base 45 to move backward.

Figure 5:
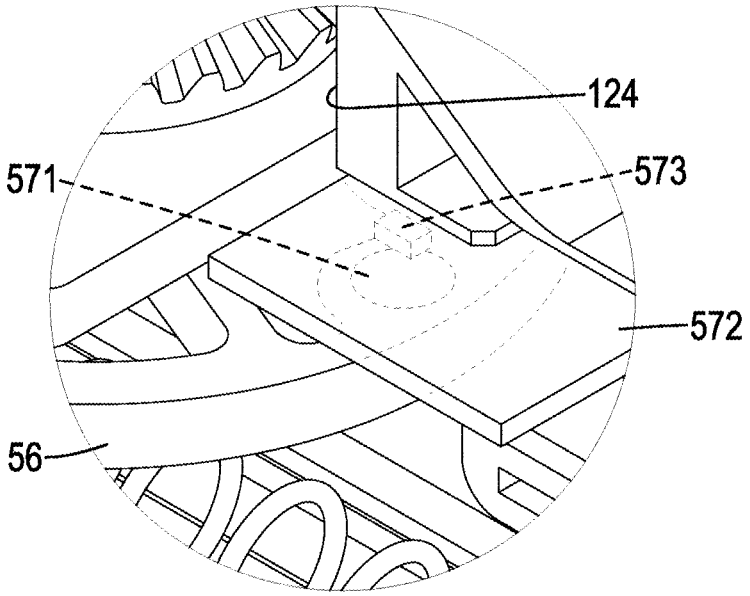
FIG. 5 is a partially enlarged perspective view of the cordless clinching tool in FIG. 3.
Figure 7:
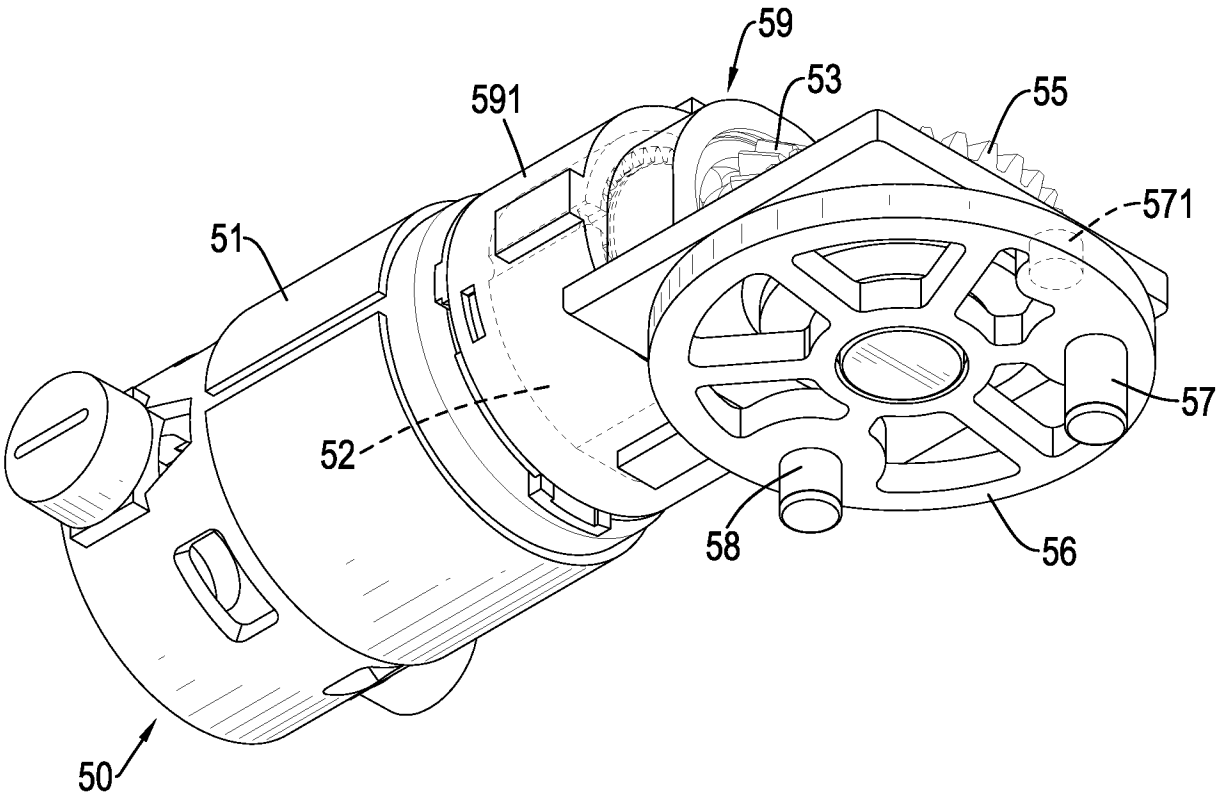
FIG. 7 is a partially enlarged perspective view of the cordless clinching tool in FIG. 1.

With reference to FIGS. 2, 5, and 7, the magnetic unit 571 is mounted in the rotating plate 56 and an initial position of the magnetic unit 571 is located at the rear of the rotating plate 56. The electric board 572 is mounted in a rear of the connecting chamber 124 and is electrically connected with the main circuit board 116. The magnetic field sensor 573 is mounted on the electric board 572. An initial position of the magnetic field sensor 573 is above the magnetic unit 571. The magnetic field sensor 573 can detect a magnetic field of the magnetic unit 571.

With reference to FIGS. 2 and 3, the cell assembly 60 is removably mounted on the cell engaging portion 111 of the grip 11 and comprises a second connecting terminal 61. The second connecting terminal 61 is mounted on a top of the cell assembly 60 and is electrically connected with the first connecting terminal 115 to provide a power generated from the cell assembly 60 to the motor 51.

With reference to FIG. 1, in use, multiple C-shaped nails A are mounted in the nail track 32. The nail pushing block 33 pushes the rear of the C-shaped nails A toward the nail entrance 213 due to the elastic force of the retractor spring 35. With reference to FIGS. 1 and 3, the button 114 is pressed to turn on the switch 113, such that the cell assembly 60 can provide a power for the motor 51 to operate.

Figure 8:
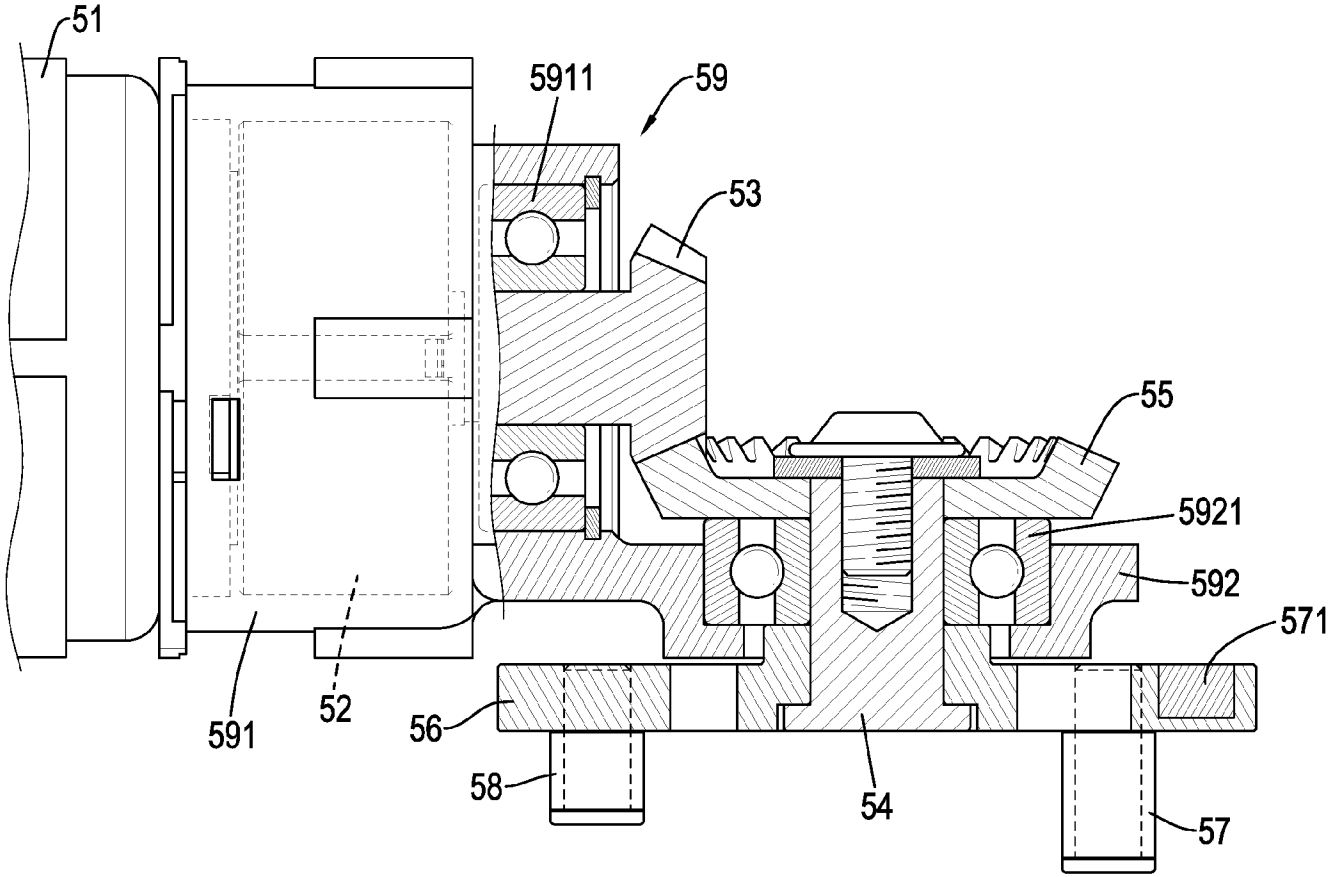
FIG. 8 is an enlarged side view in partial section of the cordless clinching tool in FIG. 1.
Figure 9:
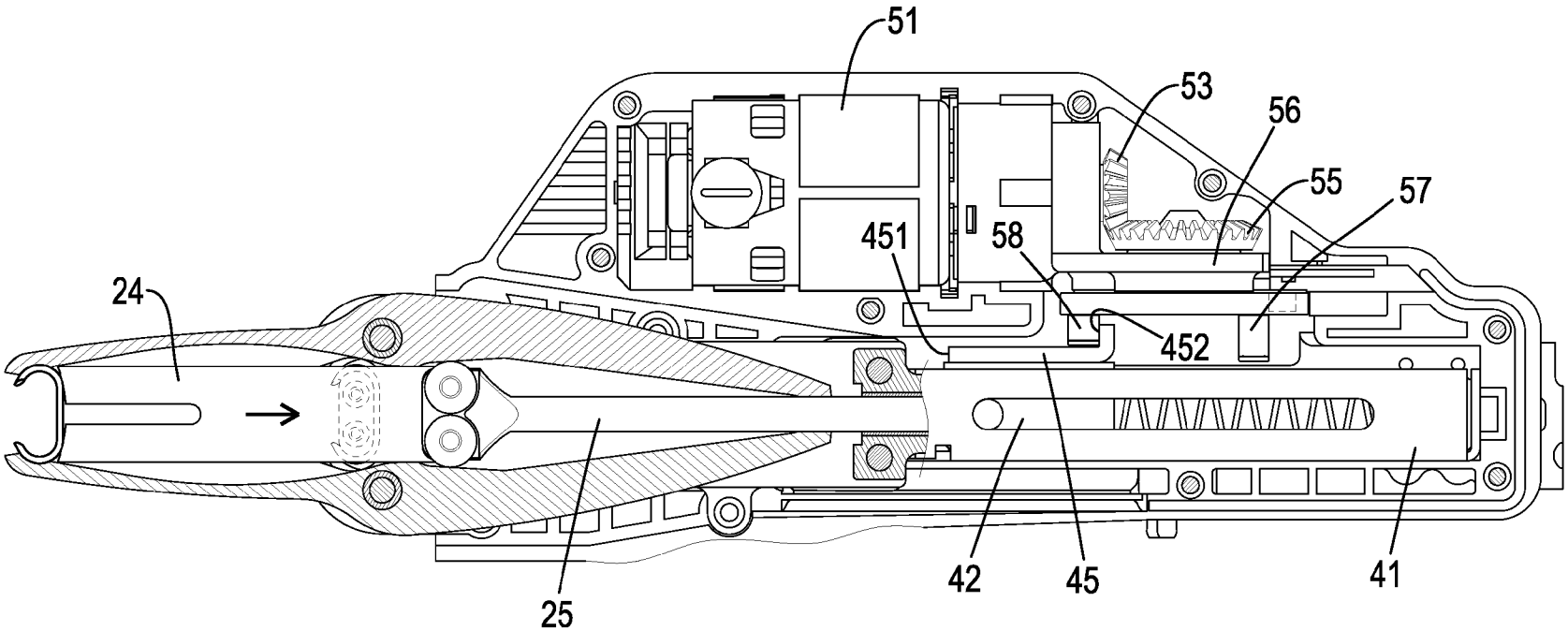
FIG. 9 is an operational side view in partial section of the cordless clinching tool in FIG. 1.
Figure 10:
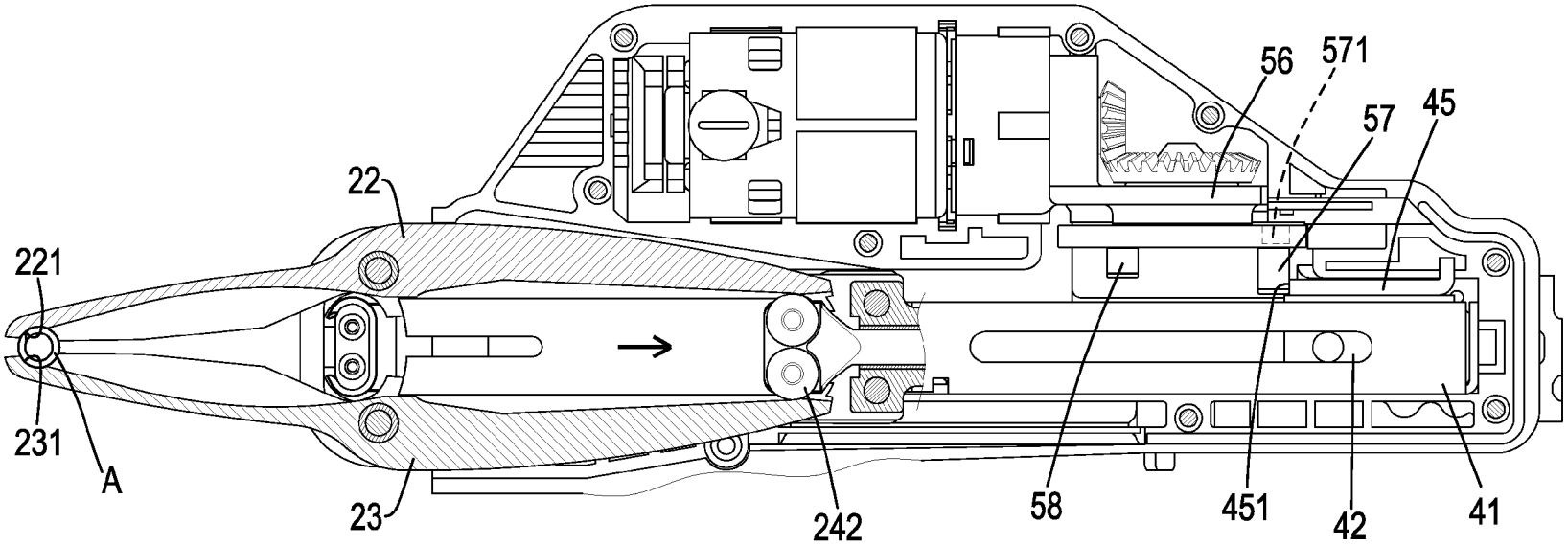
FIG. 10 is an operational side view in partial section of the cordless clinching tool in FIG. 1.

With reference to FIGS. 8 to 10, when the motor 51 is rotated, the driving bevel gear 53 is rotated by the motor 51, and then the driven bevel gear 55 and the rotating plate 56 are rotated by the driving bevel gear 53. When the rotating plate 56 is rotated, the long pushing unit 57, the short pushing unit 58, and the magnetic unit 571 are also rotated. When the short pushing unit 58 is moved to the front of the upper engaging portion 452 and pushes the upper engaging portion 452, the engaging base 45 is pushed and drives the sliding base 42 to slide backward relative to the track 41. Then, the abutting head 26 is driven to move relative to the track 41 by the sliding base 42 due to the guiding pins 421. The pushing stick 25 and the pushing plate 24 are further driven to move by the abutting head 26. The spring 44 is compressed by the moved abutting head 26 and the track 41.

When the rotating plate 56 is further rotated, the short pushing unit 58 is moved to depart from the upper engaging portion 452, and then the long pushing unit 57 is moved to abut the lower engaging portion 451. The engaging base 45 and the sliding base 42 are pushed to move toward the rear of the track 41. In the described process, the supporting wheels 242 are moved backward and support the upper clamping mouth 22 and the lower clamping mouth 23 in two opposite directions respectively, such that the rear ends of the upper clamping mouth 22 and the lower clamping mouth 23 depart from each other and the front ends of the upper clamping mouth 22 and the lower clamping mouth 23 approach each other. When the front ends of the upper clamping mouth 22 and the lower clamping mouth 23 approach each other, the upper clamping portion 221 and the lower clamping portion 231 clamp the C-shaped nail A to form a ringed structure to tie an object.

Figure 11:
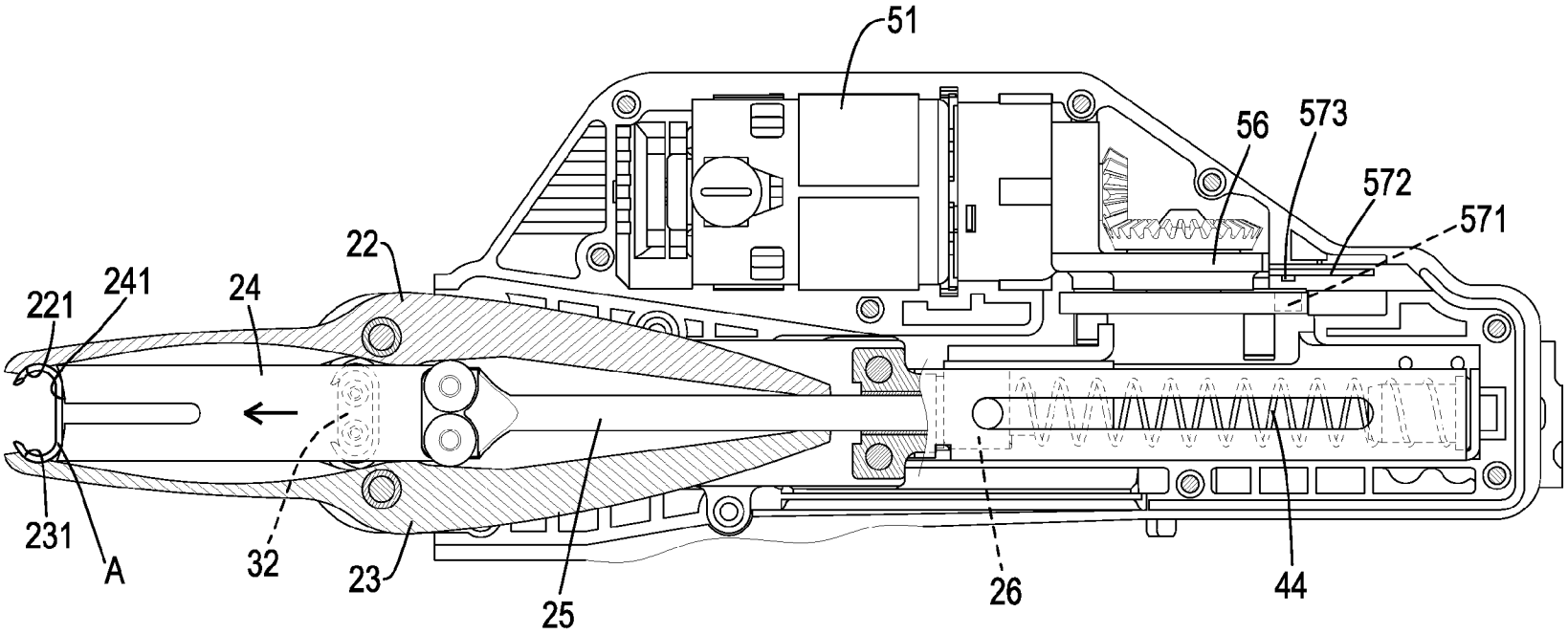
FIG. 11 is an operational side view in partial section of the cordless clinching tool in FIG. 1.

With reference to FIGS. 10 and 11, when the rotating plate 56 is further rotated, the long pushing unit 57 is moved to depart from the lower engaging portion 451, and then the abutting head 26 and the pushing stick 25 are pushed forth by the spring 44. When the abutting head 26 and the pushing stick 25 are pushed forth, the pushing plate 24 is driven to move forth to push forth a new C-shaped nail A to enter the nail clamping unit chamber 121 from the nail track 32 by the pushing surface 241. The new C-shaped nail A is pushed until the new C-shaped nail A is located between the upper clamping portion 221 and the lower clamping portion 231. When the rotating plate 56 is rotated in one revolution, the magnetic field sensor 573 detects the magnetic field generated from the magnetic unit 571 again. Then, the magnetic field sensor 573 transmits a signal to the electric board 572, and the electric board 572 transmits a signal to the main circuit board 116. After the main circuit board 116 receives the signal from the electric board 572, the motor 51 is stopped operating by the main circuit board 116. Therefore, the components of the cordless clinching tool will return to the initial positions.

The cordless clinching tool is driven by the cell assembly 60. The cell assembly 60 provides a power for the motor 51 to make the driving device 50 and the pushing device 40 coordinate with each other. The pushing stick 25 can be pulled backward by the driving device 50 and the pushing device 40 and then return to the initial position again by the spring 44 to finish an operation cycle for clamping a C-shaped nail A. The cordless clinching tool is not driven by an air compressor, and is not connected with the air compressor by pipelines, either. Therefore, the cordless clinching tool is portable and is not restricted in the working environment and the operation.

What is claimed is:

1. A cordless clinching tool comprising:

a case body comprising
- a grip comprising
  - a bottom;
  - a top;
  - a button opening formed through a front side of the top of the grip;
  - a switch mounted in the top of the grip and comprising a front side;
  - a button combined with the front side of the switch and protruding out of the grip from the button opening;
  - a cell engaging portion mounted on the bottom of the grip and comprising a bottom surface;
  - a first connecting terminal mounted on the bottom surface of the cell engaging portion; and
  - a main circuit board mounted in the bottom of the grip and electrically connected with the first connecting terminal and the switch;
- a gun body combined with the top of the grip and comprising
  - a front;
  - a rear;
  - a side;
  - a nail clamping unit chamber formed in the gun body and comprising
    - a chamber opening formed through the front of the gun body;
  - a pushing chamber formed in the gun body and communicating with the nail clamping unit chamber and comprising a middle and a rear end;
  - a driving device chamber formed in the gun body, being above the nail clamping unit chamber and comprising a rear end; and
  - a connecting chamber formed in the gun body, being above the pushing chamber and comprising
    - a middle;
    - a front end communicating with the rear end of the driving device chamber; and
    - a bottom communicating with a top of the middle of the pushing chamber;

a nail clamping unit mounted in the nail clamping unit chamber of the case body and comprising
- a side;
- a front half part protruding out of the nail clamping unit chamber from the chamber opening of the nail clamping unit chamber;
- a nail entrance formed through the side of the nail clamping unit;
- a pushing stick being elongated, mounted in the nail clamping unit and comprising a rear end; and
- an abutting head mounted on the rear end of the pushing stick and located in the pushing chamber;

a nail transportation unit mounted on the side of the gun body and comprising a nail track mounted on the side of the gun body and connected with the nail entrance;

a pushing device mounted in the pushing chamber and comprising a track being elongated and mounted in the pushing chamber;

a sliding base mounted in the track slidably, combined with the abutting head and comprising a top;

a spring mounted between the rear end of the pushing chamber and the abutting head; and an engaging base mounted on the top of the sliding base and comprising a front end;

a rear end;

a lower engaging portion mounted on the front end of the engaging base and having a height; and an upper engaging portion mounted on the rear end of the engaging base and having a height, wherein the height of the upper engaging portion is longer than the height of the lower engaging portion;

a driving device mounted in the driving device chamber and the connecting chamber and comprising a motor mounted in the driving device chamber, electrically connected with the main circuit board and comprising a rear end;

a decelerating gear assembly connected with the rear end of the motor and comprising a rear end;

a driving bevel gear connected with the rear end of the decelerating gear assembly and protruding into the connecting chamber;

a gear axle mounted in the middle of the connecting chamber rotatably and comprising a top;

a driven bevel gear mounted around the top of the gear axle, engaging with the driving bevel gear and comprising a bottom;

a rotating plate rotatably combined with the bottom of the driven bevel gear and comprising a bottom;

a long pushing unit mounted on the bottom of the rotating plate, selectively pushing the lower engaging portion and having a height; and a short pushing unit mounted on the bottom of the rotating plate, selectively pushing the upper engaging portion and having a height, wherein the height of the long pushing unit is longer than the height of the short pushing unit;

the long pushing unit and the short pushing unit are eccentric relative to the gear axle; and a cell assembly removably mounted on the cell engaging portion of the grip and comprising a top; and a second connecting terminal mounted on the top of the cell assembly and electrically connected with the first connecting terminal.

2. The cordless clinching tool as claimed in claim 1, wherein the driving device further comprises a gear base being L-shaped, mounted in the connecting chamber and comprising a front side;

a bottom;

a motor sleeve mounted at the front side of the gear base and around the decelerating gear assembly, wherein the driving bevel gear protrudes out of the motor sleeve;

a bearing base mounted at a middle of the bottom of the gear base; and a bearing mounted in the bearing base, wherein the gear axle is mounted in the bearing.

3. The cordless clinching tool as claimed in claim 2, wherein the driving device further comprises an electric board mounted in a rear of the connecting chamber and electrically connected with the main circuit board;

a magnetic field sensor mounted on the electric board; and a magnetic unit mounted in the rotating plate and selectively aligning with the magnetic field sensor.

4. The cordless clinching tool as claimed in claim 3, wherein the engaging base is L-shaped and combined with a side of the top of the siding base.

5. The cordless clinching tool as claimed in claim 4, wherein the long pushing unit and the short pushing unit are rotatable relative to the rotating plate.

6. The cordless clinching tool as claimed in claim 5, wherein the track is mounted on a right side, a left side, and a bottom surface of the pushing chamber, and comprises two guiding holes being elongated along the pushing chamber and formed through a right side and a left side of the track respectively; and the sliding base comprises a front end combined around the abutting head;

a right side;

a left side; and two guiding pins inserted into the guiding holes slidably and respectively and combined with the right side and the left side of the sliding base respectively.

7. The cordless clinching tool as claimed in claim 6, wherein the pushing chamber further comprises a spring hole formed in a rear end of the pushing chamber; and the pushing device further comprises a spring base mounted on a front side of the spring hole and abutting the spring.

* * * * *